US007296450B2

(12) United States Patent
Kuroda et al.

(10) Patent No.: US 7,296,450 B2
(45) Date of Patent: Nov. 20, 2007

(54) APPARATUS AND METHOD FOR PRODUCTION OF TAPERED STEEL PIPE

(75) Inventors: Yasuyuki Kuroda, Tokai (JP); Yukihisa Kuriyama, Futtsu (JP); Manabu Ueda, Tokai (JP); Hirotoshi Hishida, Tokai (JP); Itsuroh Hiroshige, Tokyo (JP); Takashi Motoyoshi, Tokai (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 11/179,898

(22) Filed: Jul. 11, 2005

(65) Prior Publication Data

US 2006/0016234 A1 Jan. 26, 2006

(30) Foreign Application Priority Data

Jul. 12, 2004 (JP) ..... 2004-204465
Jul. 13, 2004 (JP) ..... 2004-205810
Jul. 13, 2004 (JP) ..... 2004-205811
Jan. 5, 2005 (JP) ..... 2005-000513

(51) Int. Cl.
*B21D 19/00* (2006.01)

(52) U.S. Cl. ..... 72/100; 72/95; 72/8.5; 72/10.3; 72/342.1

(58) Field of Classification Search ..... 72/8.5, 72/8.8, 11.3, 11.5, 12.2, 84, 95, 100, 102, 72/107, 110, 112, 120, 342.1, 10.3
See application file for complete search history.

(56) References Cited

U.S. PATENT DOCUMENTS 3,363,442 A * 1/1968 Kennedy et al. ..... 72/123
3,431,764 A * 3/1969 Kennedy et al. ..... 72/78
3,495,429 A * 2/1970 Muller ..... 72/100
4,175,414 A * 11/1979 Peytavin ..... 72/96
4,480,455 A * 11/1984 Bramer ..... 72/95

FOREIGN PATENT DOCUMENTS

JP 57-139420 * 8/1982
JP 60-227910 * 11/1985
JP 63-260612 * 10/1988
JP 2002192225 A 7/2002
JP 2002292433 A 10/2002

* cited by examiner

*Primary Examiner*—Ed Tolan
(74) *Attorney, Agent, or Firm*—Kenyon & Kenyon LLP

(57) ABSTRACT

A production apparatus for a tapered steel pipe which holds the two ends of the steel pipe by shafts on carriers and moves it in the axial direction while rotating it to draw it to a taper by an intermediate working roll, wherein the shaft of the working roll is inclined 20 to 40 degrees with respect to the axis of the steel pipe and a roll caliber of the working roll is made an outwardly curved surface with little difference in roll peripheral speed; the face plate for mounting the working roll is positioned and supported with respect to the body by a hinge mechanism and is fastened to the body by fastening members; and the bearing of the working roll at the side close to the steel pipe is made smaller than the bearing at the side far from the steel pipe and the two bearings are connected by a tie-rod.

11 Claims, 12 Drawing Sheets

APPARATUS AND METHOD FOR PRODUCTION OF TAPERED STEEL PIPE

BACKGROUND OF THE INVENTION

1. Field of the Invention

The present invention relates to an apparatus and method for hot drawing electroresistance welded steel pipe, welded steel pipe, seamless steel pipe, etc., more particularly relates to an apparatus and method for production of tapered steel pipe comprised of steel pipe with an outside diameter gradually changed in the axial direction.

2. Description of the Related Art

Tapered steel pipe comprised of steel pipe with an outside diameter gradually changed in the axial direction and with ridge of the steel pipes inclined with respect to its axis is being used for road light poles etc. Apparatuses for producing such tapered steel pipe by drawing (or spinning) are, for example, disclosed in Japanese Patent Publication (A) No. 10-24323, Japanese Patent Publication (A) No. 11-197755, Japanese Patent Publication (A) No. 2002-192225, Japanese Patent Publication (A) No. 2002-292432, and Japanese Patent Publication (A) No. 2002-292433.

These apparatuses for production of steel pipe hold the two ends of the steel pipe on shafts on carrier and move it in the axial direction while rotating it to draw it into a taper by an intermediate working roll. Note that the steel pipe is heated as a whole in a heating oven or is partially heated by a heating apparatus set at the entry side of the working roll. The drawing is performed hot at a temperature of several hundred degrees centigrade.

Normally, in an apparatus for production of a tapered steel pipe, as shown in FIG. 15, the working roll 28 is set so that its shaft is parallel to the axis of rotation of the steel pipe P. In this case, if hot drawing (or hot spinning) the pipe at a high speed, there were the problem that the outside shape did not become round but ended up becoming polygonal and the problem of a variation in thickness and due to this a large amount of orange peel surface ended up occurring.

Further, the angle (taper angle) of the ridges of the tapered steel pipe with respect to the axial direction is determined by the speed of advance/retraction of the working roll in the direction from the outer circumference of the steel pipe to the center axis (radial direction) and the speed of movement in the longitudinal direction (axial direction) of the steel pipe. Normally, the steel pipe is pulled by one carrier, while the other carrier moves trailing it. The other carrier imparts a suitable tension to the steel pipe for improving the shape of the tapered steel pipe. Further, the steel pipe is imparted with a rotational force by a shaft placed on either of the carriers, while the shaft of the other carrier follows the rotation of the pipe. In this way, the steel pipe rotates at a constant speed while contacting the working roll and being drawn. Note that the working roll is not imparted any drive force and is a freely rotating type which rotates by contact with the steel pipe.

If using such a production apparatus to, for example, draw a long electroresistance welded steel pipe with a total length of over 10 meters at a high speed, as shown in FIG. 16, the seam line of the steel pipe sometimes becomes twisted. If this twisting of the seam line becomes severe, the pipe easily becomes polygonal in cross-section, twisted, bent, or otherwise defective. The reason for the twisting of the seam line is the difference in the peripheral speed of the worked part of the steel pipe and the peripheral speed of the working roll arising due to the fact that the peripheral speed of the large inertia moment working roll cannot keep up with the change in the peripheral speed of the worked part of the steel pipe. Therefore, when drawing a long steel pipe, the speed of movement of the steel pipe in the axial direction has to be made slower and the change in the peripheral speed of the worked part of the steel pipe has to be made smaller and therefore there was the problem of a drop in the productivity.

In particular, the working defect rate is high in the case of a stock pipe (a raw workpiece) with an outside diameter of 160 mm and in the case of a tapered steel pipe with a maximum value of the outside diameter of 150 mm or less. This is because if the diameter of the steel pipe becomes smaller than the diameter of a working roll, the resistance to cross-sectional deformation of the steel pipe becomes relatively weak and the working instability increases. Further, the working defect rate is also high in the case of drawing a stock pipe with a thickness of less than 4.0 mm and the case of producing a tapered steel pipe with a maximum value of thickness of less than 4.0 mm. This is believed to be because if the thickness becomes smaller, the resistance to cross-sectional deformation of the steel pipe becomes weak in absolute terms and again the working instability increases. Further, even when the minimum value of the outside diameter of the tapered steel pipe is 20% or less of the outside diameter of the stock pipe, the working defect rate is high. This is believed to be due to the high taper rate, that is, the increase in drawing, and therefore the increase in external force and the increase in working instability itself.

Further, the optimum working temperature when drawing the steel pipe (optimum working temperature) differs depending on the type of steel. Control to a suitable range is preferable. If calculated from the rate of change of strength of the steel pipe, the heating apparatus is particularly preferably controlled so that the temperature of the steel pipe after heating to when reaching the working roll becomes a range of the optimum working temperature ±20° C. Conventionally, when drawing steel pipe hot, the output of the heating apparatus has been adjusted so that the temperature of the steel pipe becomes the optimum working temperature at the exit side of the heating apparatus.

In general, anti-swing rings or other devices are provided between the heating apparatus and the working roll of a tapered steel pipe production apparatus, so the distance between the heating apparatus and working roll is made approximately 600 mm. Further, the speed of movement of the steel pipe in the axial direction when producing a tapered steel pipe is 0.5 to 0.7 m/min. Therefore, after the steel pipe is heated at the heating apparatus, it takes over 1 minute or so until reaching the working roll. Air cooling reduces the temperature of the steel pipe to as low as 100° C. When the temperature drops sharply in this way, the response time in temperature control of the heating apparatus is long, so control of the temperature is difficult. Therefore, the method of adjusting the output of the heating apparatus so that the temperature of the steel pipe at the exit side of the heating apparatus becomes the optimum working temperature is suitable for production of tapered steel pipe.

As opposed to this, it is also possible to assume that the amount of temperature drop due to the air cooling in the interval from the end of heating the steel pipe to the drawing operation is constant, set a constant temperature drop constant, and control the temperature of the steel pipe at the exit side of the heating apparatus. However, to secure working stability, generally the working speed is set constant. For example, when the amount of drawing becomes larger, inversely proportional to this, the speed of the steel pipe at the entry side, that is, the speed of the steel pipe passing through the heating apparatus, becomes slower. Therefore, along with the drawing work, the temperature drop becomes greater, so even if setting the temperature drop constant, it is difficult to maintain a suitable working temperature.

In addition, even a change in the temperature around the production apparatus due to the season or time has an effect on the temperature drop constant. Further, the steel pipe is cooled by contact with the water-cooled working roll, so even a change in volume of the steel pipe resulting from the drawing conditions has an effect on the temperature drop constant. From the above, with the method of setting a constant temperature drop constant and controlling the temperature at the exit side of the heating apparatus, maintaining a suitable working temperature is difficult. Still further, when producing a steel pipe with a non-constant taper rate, hunting inevitably ends up occurring if performing control with the target temperature set constant.

From the above, adjusting the output of the heating apparatus so that the temperature of the steel pipe when reaching the working roll becomes the optimum working temperature (target temperature) is extremely difficult. In the past, control of the heating temperature has been dependent on the experience of the workers. Therefore, stable operation has not been able to be secured all the time. The steel pipe is liable to be overheated at the exit side of the heating apparatus, the deformation resistance of the steel pipe is liable to fall, deformation is liable to occur before reaching the working roll, and other trouble is liable to occur.

SUMMARY OF THE INVENTION

An object of the present invention is to provide an apparatus and method for production of tapered steel pipe solving the above problems and enabling the high speed production of high quality tapered steel pipe having a uniform thickness with no thin parts and having no orange peel surface. Another object of the present invention is to produce tapered steel pipe with a length of over 10 meters without causing twisting and with a good productivity. Still another object of the present invention is to adjust the output of the heating apparatus in accordance with the working conditions so that the temperature of the heating part of the steel pipe reaching the working roll becomes the optimum working temperature (target temperature) and thereby enable optimum tapering.

According to a first aspect of the present invention, there is provided a production apparatus of a tapered steel pipe which holds the two ends of the steel pipe by shafts on carriers and moves it in the axial direction while rotating it to draw it to a taper by an intermediate working roll, wherein a shaft of the working roll is inclined 20 to 40 degrees with respect to an axis of rotation of the steel pipe, and a roll caliber (surface profile) of the working roll is made an outwardly curved surface with little difference in roll peripheral speed. Further, a face plate for mounting the working roll is positioned and supported with respect to the body by a hinge mechanism and is preferably fastened to the body by fastening members. Further, preferably a bearing of the working roll at the side close to the steel pipe is made smaller than the bearing at the side far from the steel pipe and the two bearings are connected by a tie-rod.

Further, the apparatus is preferably provided with a steel pipe rotating means for rotating the shaft on at least one bogie among the shafts on the carriers holding the two ends of the steel pipe, a speed detecting means for measuring the speed $\theta r$ of the working roll rotating due to contact with the steel pipe, and a control means for controlling the steel pipe rotating means based on a difference $\Delta$ between the worked part peripheral speed Vp of the steel pipe and the worked part peripheral speed Vr of the working roll. The working roll speed measuring means is preferably a non-contact type sensor.

Further, the apparatus preferably has a heating apparatus at the entry side of the working roll, has temperature detecting means right after the heating apparatus and right before the working roll, and has a processing means for adjusting the output of the heating apparatus based on a temperature measured by the temperature detecting means and a temperature drop constant set in accordance with the working conditions.

According to a second aspect of the invention, there is provided a method of production of the above tapered steel pipe according to the above production apparatus comprising measuring a speed $\theta r$ of the working roll rotating due to contact with the steel pipe during drawing, finding the worked part peripheral speed Vr of the working roll from the speed $\theta r$, finding the worked part peripheral speed Vp of the steel pipe from the speed $\theta p$ of the steel pipe, and controlling the speed $\theta p$ of the steel pipe so that the absolute value of the difference $\Delta$ between the worked part peripheral speed Vp of the steel pipe and the worked part peripheral speed Vr of the working roll does not exceed an allowable range. More preferably, the absolute value of the difference $\Delta$ between the worked part peripheral speed Vp of the steel pipe and the worked part peripheral speed Vr of the working roll satisfies $|\Delta| \leqq 0.045$ Vr.

Further, the method more preferably comprises measuring the temperature of the steel pipe right after the heating apparatus and right before the working roll, adjusting the output of the heating apparatus so that the difference of the measurement value matches the amount of temperature drop calculated from the temperature drop constant set in accordance with the working conditions, and then drawing the pipe. Further, it preferably changes the set value of the temperature drop constant in accordance with the amount of drawing and more preferably changes the set value of the temperature drop constant in steps in the longitudinal direction of the steel pipe.

BRIEF DESCRIPTION OF THE DRAWINGS

These and other objects and features of the present invention will become clearer from the following description of the preferred embodiments given with reference to the attached drawings, wherein.

DESCRIPTION OF THE PREFERRED EMBODIMENT

Below, preferred embodiments of the present invention will be described with reference to the drawings.

Figure 1:
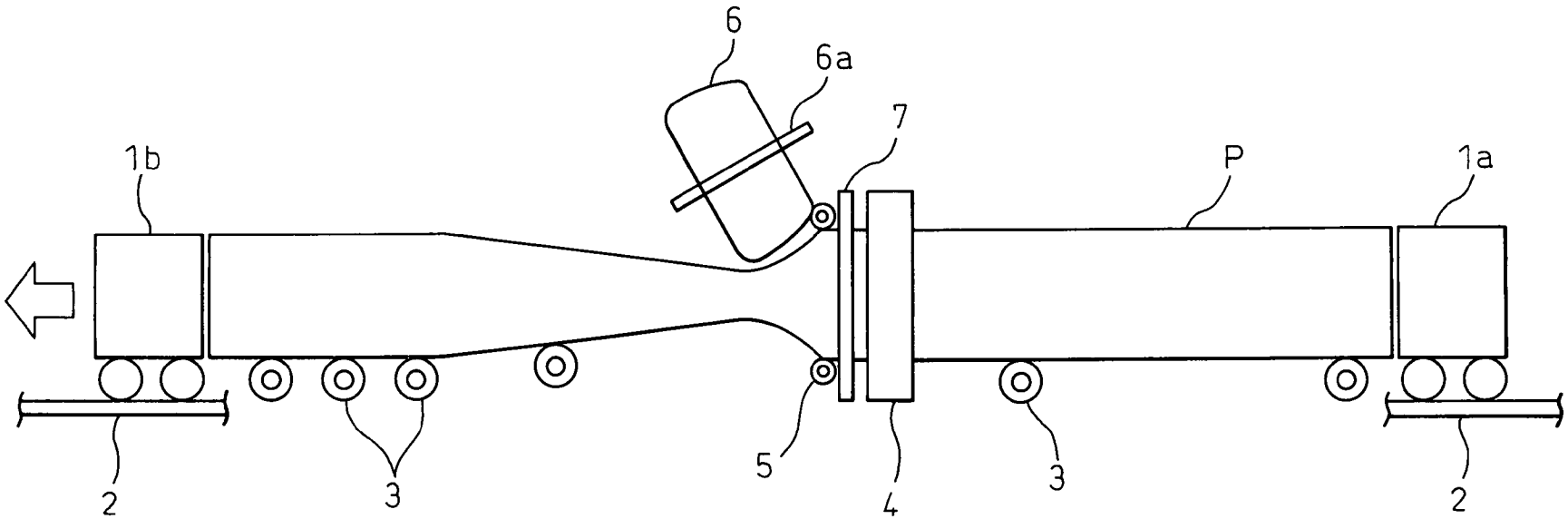
FIG. 1 is a front overall view of an embodiment of the present invention.
Figure 2:
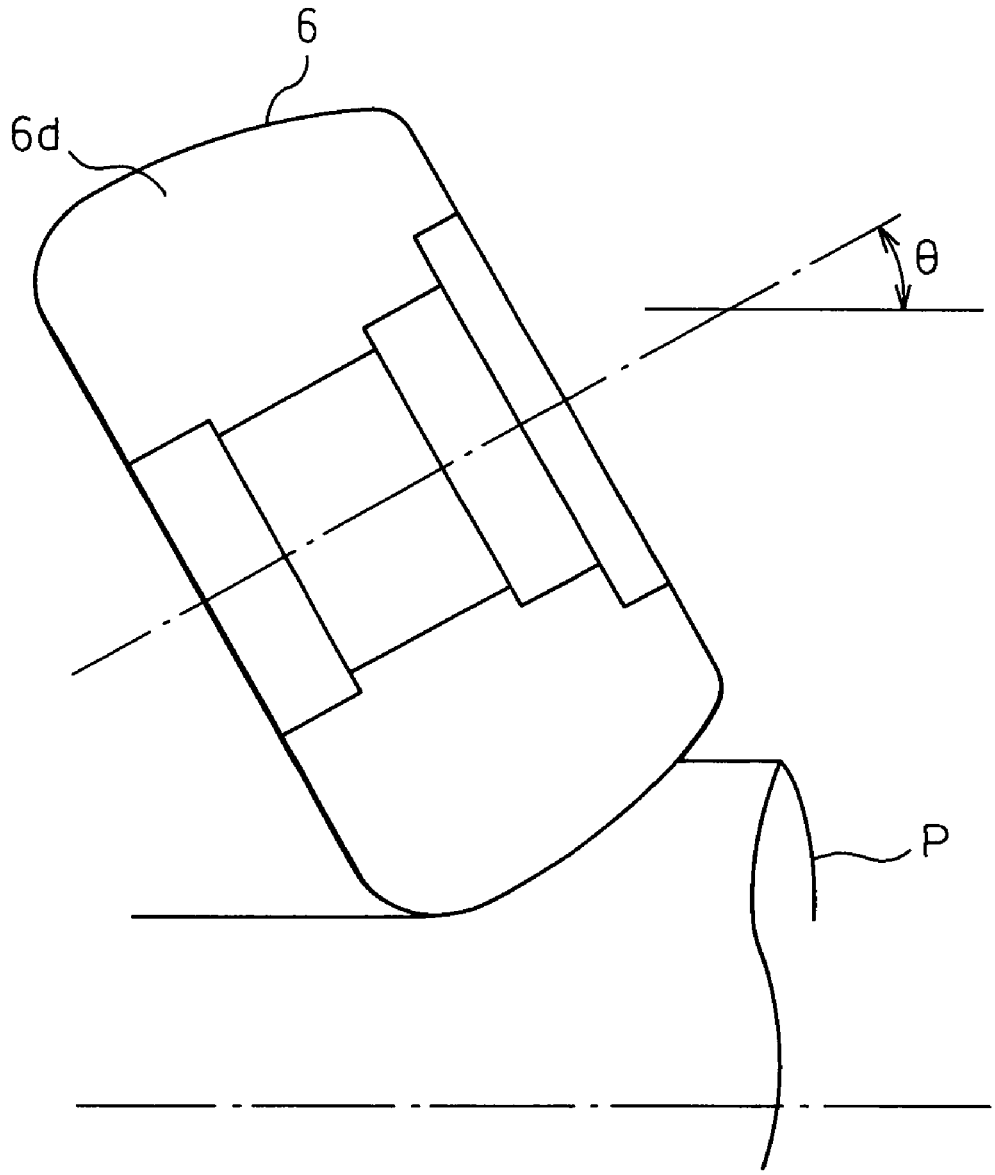
FIG. 2 is a front view of a working roll of the present invention.

First, an apparatus and method for production of a high quality tapered steel pipe having a uniform thickness with no thin parts and no orange peel surface at a high speed will be explained. FIG. 1 is a front overall view of a production apparatus of a tapered steel pipe, while FIG. 2 is a front view of a working roll. In FIG. 1, P indicates a steel pipe, while 1*a* and 1*b* indicate shafts holding and rotating the two ends of the steel pipe P and moving the pipe by bogies on rails 2 in the axial direction. In the embodiment shown in FIG. 1, 1*a* indicates a drive side provided with a rotational motor, while 1*b* indicates a free side following the rotation. Further, 3 indicates receiving rollers of the steel pipe, 4 a heating apparatus, and 5 an anti-swing ring. The point of being configured to be tapered by a working roll 6 in the middle is basically the same as in a conventional production apparatus of a tapered steel pipe.

Figure 15:
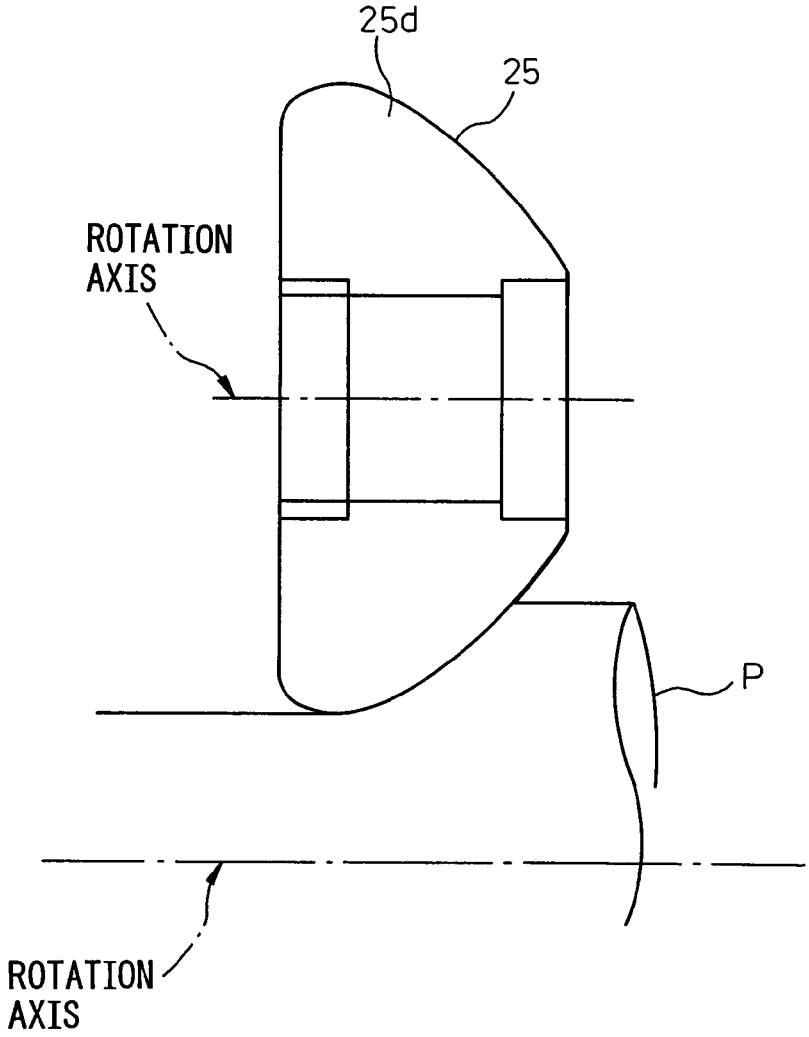
FIG. 15 is a front view of a conventional example of a working roll.

The inventors engaged in intensive research to prevent deformation of shape, prevent variations in thickness and orange peel surface, and cope with higher speeds in the production of tapered steel pipe. As a result, they discovered that rather than setting the working roll so that its shaft is parallel to the axis of rotation of the steel pipe as in the past, inclining it slightly is effective in preventing deformation, preventing orange peel surface, etc. Further, due to this, it is also possible to improve the working speed. However, it was learned that if using the working roll 25 shown in FIG. 15 inclined in its shaft, the contact area between the roll 25 and outside surface of the steel pipe P becomes smaller and further acute drawing results and the thickness declines.

As opposed to this, the inventors discovered that the shape of a working roll affects the reduction in thickness and therefore engaged in intensive research on the optimal shape. As a result, as shown in FIG. 2, they found that by making the roll caliber 6*d* an outwardly curved surface with a small roll peripheral speed, the reduction in thickness can be effectively prevented and a uniform thickness tapered steel pipe can be produced. That is, by securing a sufficient contact area between the outside surface of the roll and the steel pipe P and using a gently sloped roll caliber 6*d*, it is possible to prevent the reduction in thickness unable to be prevented by the conventional roll caliber 25*d* shown in FIG. 15.

Specifically, as shown in FIG. 2, the working roll 6 is attached inclined in its shaft in a range of 20 degrees $\leqq\theta\leqq$40 degrees with respect to the axis of rotation of the steel pipe P. If the angle of intersection ($\theta$) is less than 20 degrees, it is difficult to sufficiently prevent deformation or prevent orange peel surface, while if larger than 40 degrees, the effect is obtained, but this is not preferable in terms of rigidity of the apparatus and the cost increases.

Further, the roll caliber 6*d* of the working roll 6, as shown in FIG. 2, was made an outwardly curved surface with little difference in roll peripheral speed. The "outwardly curved surface with little difference in roll peripheral speed" means an outwardly curved surface with little difference between the radius of the working roll 6 at the entry side of the steel pipe and the radius of the working roll 6 at the exit side of the steel at the contact part of the working roll 6 and steel pipe P. The entire outwardly curved surface is press worked substantially uniformly with respect to the steel pipe. That is, the roll caliber 6*d* of the working roll 6 is configured so that the contact part between the working roll 6 and steel pipe P forms a smooth horizontal line at the exit side of the steel pipe and it is possible to produce a tapered steel pipe with a uniform thickness with no step differences, local recesses, etc. and prevented from any reduction in thickness.

Note that as further means for preventing deformation of shape, variations in thickness, and orange peel surface and increasing the speed, it is preferable to reduce the working load of the working roll by arranging three working rolls 6 evenly in the circumferential direction of the steel pipe.

However, since the working roll 6 is worn by contact with the steel pipe, it has to be replaced at periodic intervals. In the past, the work of replacing the working roll was performed by detaching the entire face plate 7 from the body in the horizontal direction. In this case, considerable work space was required. When however there is an intersecting angle at the working roll 6 like in the present invention, an even greater work space is required. Further, in the past, it was necessary to detach the face plate 7 by a crane during the work of detaching the fastening members 9 or the work of replacing the roll. Further, several dozen fastening members 9 were also necessary, so the work efficiency was poor. Further, there was also the problem that the precision of reproduction of the mounting position at the time of attachment of the face plate 7 fell.

Figure 3:
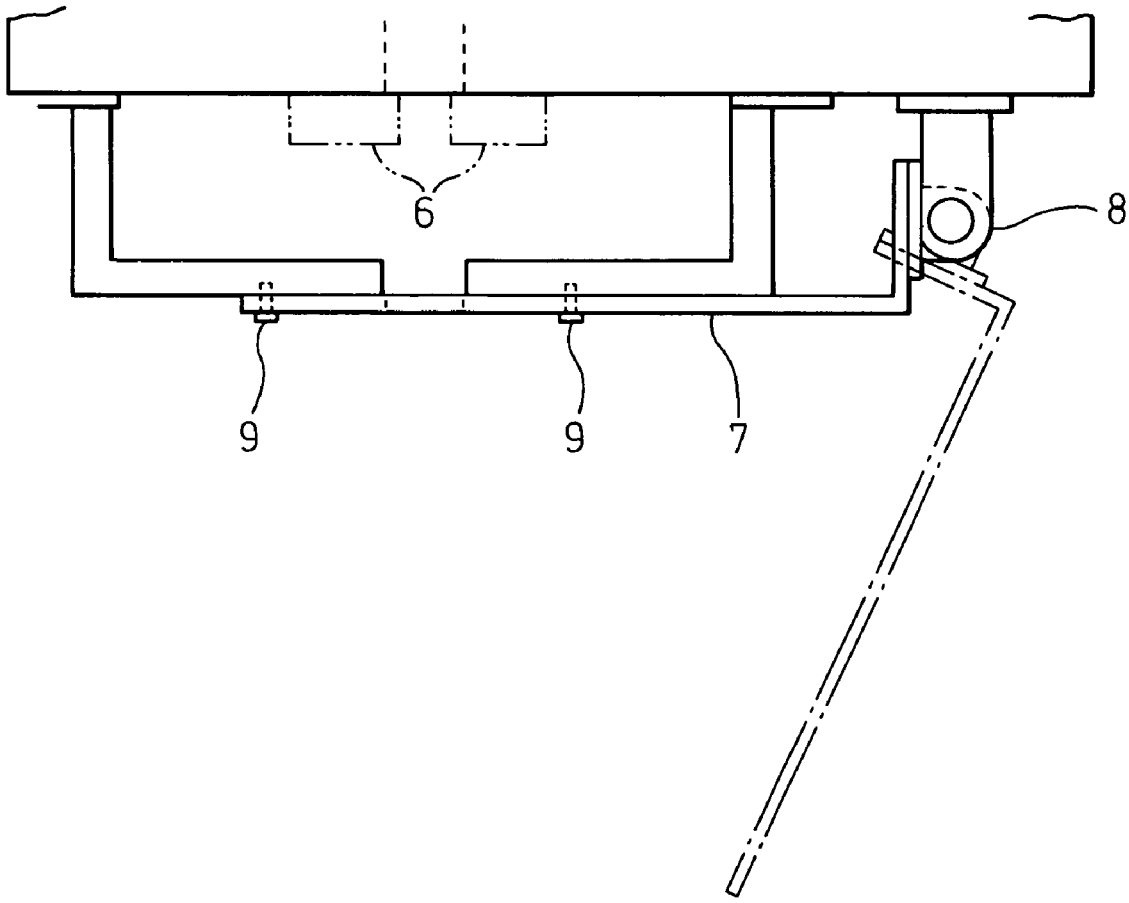
FIG. 3 is a plan view of a pivoting structure of the face plate of the present invention.

As opposed to this, as shown in FIG. 3, the face plate 7 covering the working roll 6 is designed to be positioned and supported with respect to the body by the hinge mechanism 8 and to be fastened with respect to the body by bolts or other fastening members 9. Note that, in the example shown in FIG. 3, the face plate 7 is L-shaped. The base part is connected by a hinge mechanism 8 to the body and can pivot about the hinge mechanism 8. Due to this, movement is possible by just a pivoting operation without use of a crane and therefore work efficiency is superior. Further, the face plate 7 can be securely fastened just by bolting it at several locations. Further, since the face plate 7 is positioned and supported by the hinge mechanism 8, the precision of mounting can also be raised.

Further, normally, the working roll receives a large counterforce from the steel pipe P at the time of drawing, so the shaft of the working roll is structured to be supported at its two ends by large bearings. However, in the present invention, the shaft 6*a* of the working roll 6 is attached at an inclination with respect to the axis of rotation of the steel pipe P, so if using conventional large bearings as they are, they would end up striking the outside surface of the steel pipe P. Therefore, the bearing 6*b* at the side close to the steel pipe P has to be made one small in size, but sufficient rigidity cannot be obtained with a small bearing. As a result, the problem arose of leakage of the internal cooling oil for cooling the area around the shaft of the working roll.

Figure 4:
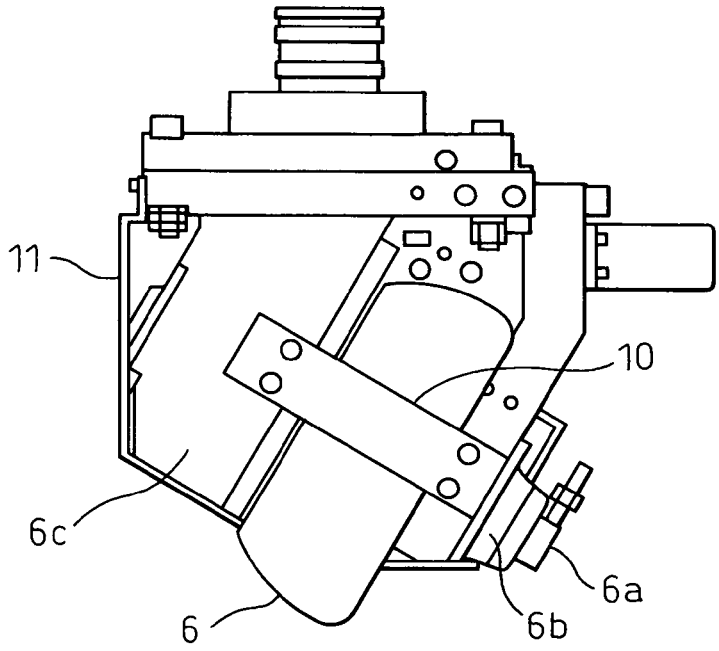
FIG. 4 is a front view of a support structure of a working roll of the present invention.
Figure 5:
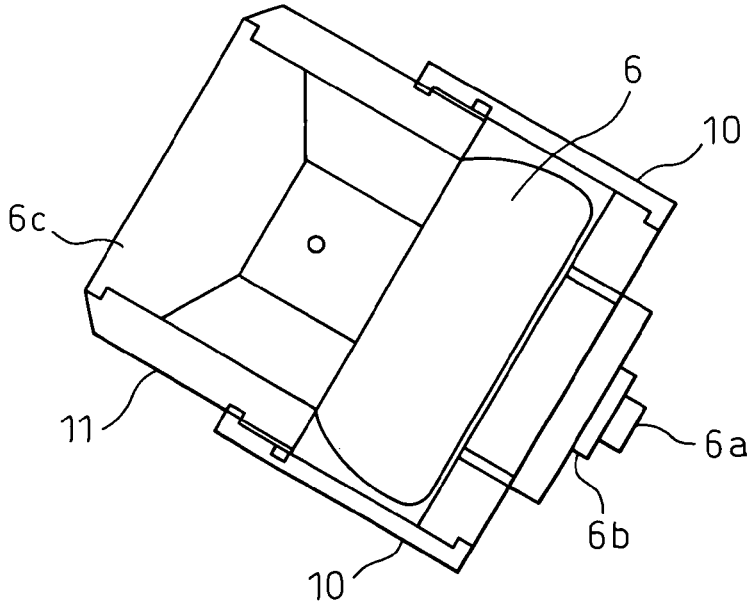
FIG. 5 is a plan view of a support structure of a working roll of the present invention.

Therefore, in the present invention, as shown in FIG. 4 and FIG. 5, the bearing 6*b* of the working roll 6 at the side close to the steel pipe P is made smaller than the bearing 6*c* at the side far from the steel pipe, and these two bearings 6*b* and 6*c* are connected by a tie-rod 10. Due to this, it is possible to increase the rigidity of support of the working roll and prevent oil leakage etc. Note that in the figure, 11 indicates a bearing bracket.

Figure 6:
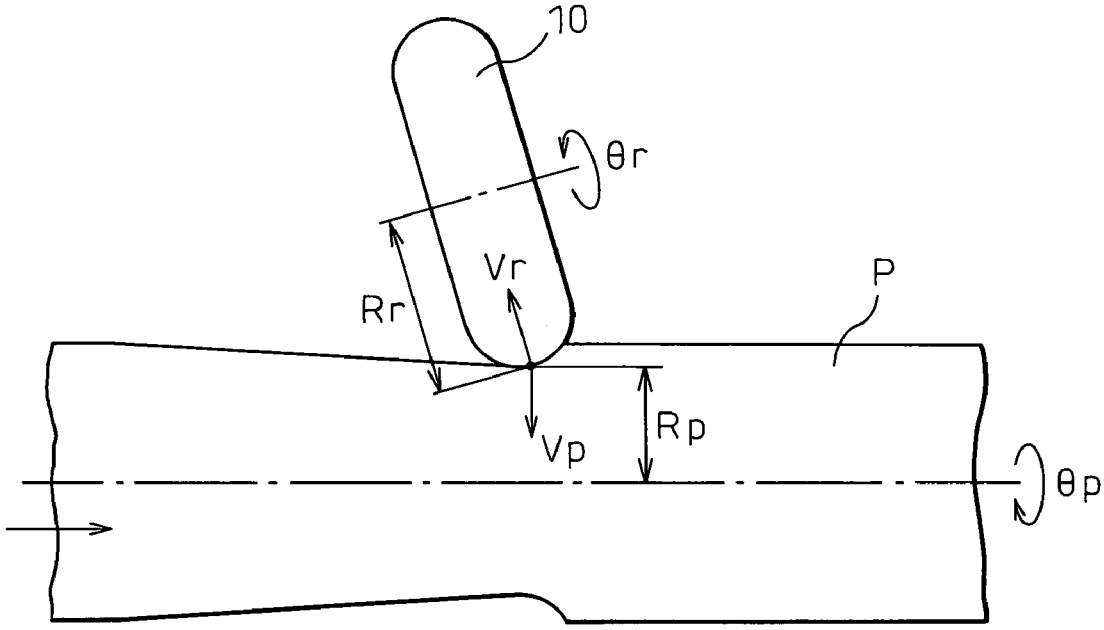
FIG. 6 is a view explaining the reference notations.

Next, the apparatus and method for producing tapered steel pipe of a length over 10 meters without any twisting and with a good productivity will be explained. FIG. 6 schematically shows the speed and peripheral speed of the steel pipe and working roll at the time of production of the tapered steel pipe. Here, if the speed of the steel pipe is θp, the speed of the working roll is θr, the worked part peripheral speed of the steel pipe is Vp, and the worked part peripheral speed of the working roll is Vr, the worked part peripheral speed Vp of the steel pipe is the product of the worked part radius Rp of the steel pipe and the speed θp of the steel pipe, and the worked part peripheral speed Vr of the working roll is the product of the working roll radius Rr and the working roll speed θr. Note that the roll caliber of the working roll, as shown in FIG. 6, is an outwardly curved surface with little difference in roll peripheral speed, while the working roll radius Rr is the maximum value of the distance between the shaft of the working roll and the curved surface contacting the steel pipe.

At the initial stage of the drawing, the working roll contacts the steel pipe rotating at a constant speed and is driven by friction. The worked part peripheral speed Vr of the working roll is accelerated until substantially matching the worked part peripheral speed Vp of the steel pipe. As the drawing work progresses, the worked part radius Rp of the steel pipe gradually becomes smaller. Since the speed θp of the steel pipe is constant, the worked part peripheral speed Vp of the steel pipe also gradually becomes smaller. However, the working roll is a heavy object and has a large moment of inertia of rotation, so the speed θr of the working roll does not easily fall. Therefore, the drop in the worked part peripheral speed Vr of the working roll becomes slower than the drop in the worked part peripheral speed Vp of the steel pipe.

Figure 16:
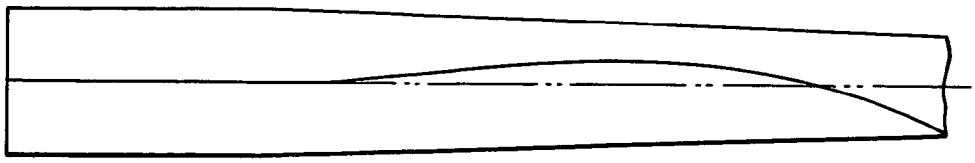
FIG. 16 is a view of twisting of a seam line.

From the above, in the initial stage of drawing, the rotation of the working roll is slower than the rotation of the steel pipe, while at the end stage of drawing, the rotation of the working roll becomes faster than the rotation of the steel pipe. For this reason, the frictional force with the working roll acting on the surface of the steel pipe in the circumferential direction becomes opposite in direction to the direction of rotation of the steel pipe in the first half of the drawing operation, while becomes the same direction in the latter half of the drawing operation. Therefore, the worked part of the steel pipe is twisted and, as shown in FIG. 16, the seam line is deformed.

This embodiment suppresses deformation of the seam line occurring due to the above reasons by continuously controlling the speed θp of the steel pipe so that the difference Δ between the worked part peripheral speed Vp of the steel pipe and the worked part peripheral speed Vr of the working roll does not exceed an allowable range. The details will be explained below.

Figure 7:
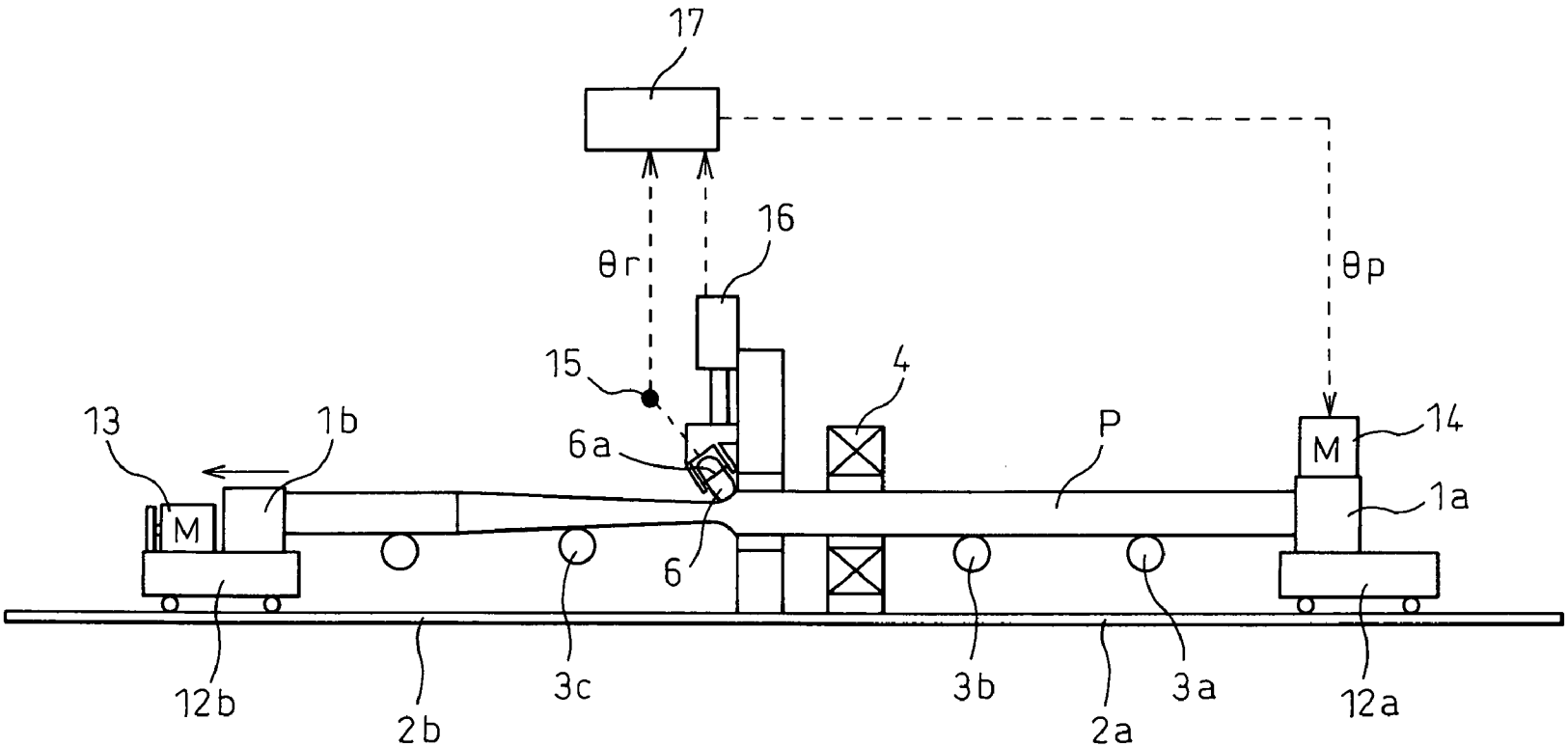
FIG. 7 is an overview of a tapered steel pipe production apparatus in an embodiment of the present invention.

FIG. 7 is an overall view of a tapered steel pipe production apparatus, where 6 indicates a working roll set at the center of the apparatus. At the two sides of the working roll 6, bogie rails 2*a* and 2*b* are arranged in straight lines. These bogie rails 2*a* and 2*b* have a pullout side carrier 12*b* and a feed side carrier 12*a* arranged on them. These bogies 12*a* and 12*b* carry shafts 1*a* and 1*b*. The steel pipe P has the two ends chucked by the shafts 1*a* and 1*b*, is heated while rotating to several hundred degrees centigrade by a heating apparatus 4 in front of the working roll 6, and is drawn by the working roll 6.

The pullout side carrier 12*b* is provided with an axial movement motor 13 and runs on the carrier rail 2*b* to move the steel pipe P in the axial direction. On the other hand, the feed side carrier 12*a* imparts a suitable tension to the steel pipe P and moves following this. Note that by providing the feed side carrier with an axial movement motor and making it move faster than the pullout side carrier 12*b*, it is possible to impart compressive force to the steel pipe P.

Figure 8:
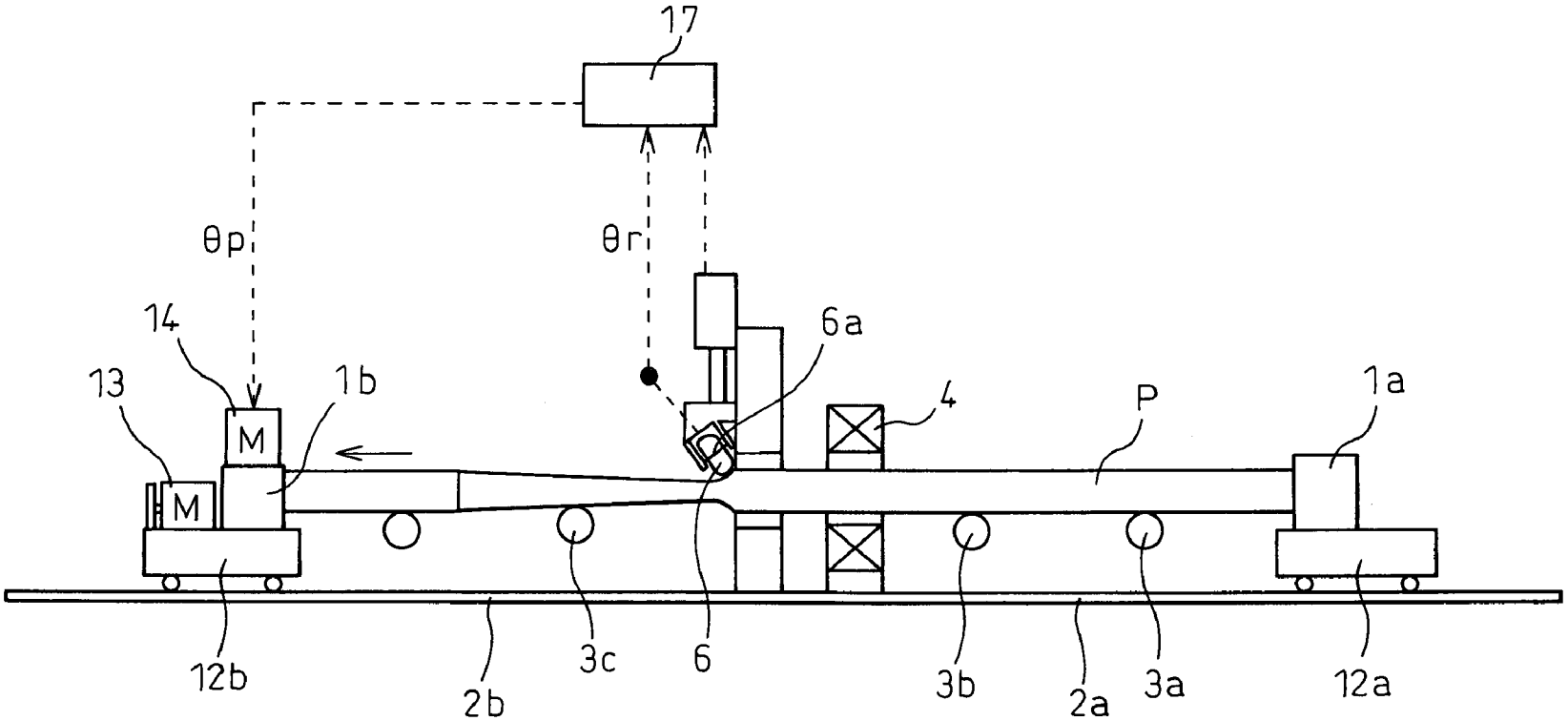
FIG. 8 is an overview of a tapered steel pipe production apparatus in another embodiment of the present invention.

Further, in the embodiment shown in FIG. 7, the feed side carrier 12*a* carries a rotational motor 14 and imparts rotational force to the steel pipe P from its shaft 1*a*. The rotational force to the steel pipe P, as shown in FIG. 8, can be obtained by mounting a rotational motor 14 on the pullout side carrier 12*b* and giving force from the pullout side. As shown in the example shown in FIG. 7, according to the method of imparting rotational force to the steel pipe P from the feed side carrier 12*a*, the part heated to a high temperature between the working roll 6 and the drive shaft becomes shorter and twisting of the steel pipe P can be effectively suppressed.

The working roll 6 of the present embodiment, as shown in FIG. 7, is arranged with its shaft 6*a* inclined with respect to the axis of the steel pipe P. Further, the working roll 6 does not have a drive means, i.e., is a freely rotating roll rotating following the rotation of the steel pipe by friction with the steel pipe P. The working roll 6 is designed to advance and retract in the direction from the outer circumference of the steel pipe P to its center axis (radial direction) by a cylinder or other driving means 16. The position of advance/retraction is constantly detected. Note that preferably three working rolls 6 are arranged at 120 degree intervals around the axis of the steel pipe P.

In the present embodiment, the speed θr of the working roll 6 rotating freely in contact with the steel pipe P is constantly measured by the speed detecting means 15 along with the progress in the drawing operation. However, this working roll 6 is inclined in its shaft 6*a* and is at a position close to the steel pipe P. Further, the ambient temperature also becomes a high temperature. For this reason, a usual speed detecting means is difficult to attach. Further, it cannot be used over a long period. Therefore, as the speed detecting means 15, a non-contact type sensor is preferably used.

The measured speed θr of the working roll 6 is input to the control apparatus 17. Further, the control apparatus 17 receives as input the amount of pushing of the working roll 6 in the radial direction from the driving means 16 of the working roll 6 at all times. Using the amount of pushing of the working roll 6 in the radial direction, the control apparatus 17 maintains a constant grasp of the worked part radius Rp of the steel pipe. Further, the control apparatus 17 controls the speed of the rotational motor 14, so maintains a grasp of the speed θp of the steel pipe. Further, the control apparatus 17 receives as input in advance the working roll radius Rr. Note that the roll radius Rr of the worked part, as shown in FIG. 6, is the maximum value of the radius of the working roll having the outwardly curved surface.

The control apparatus 17 multiplies the worked part radius Rp of the steel pipe with the speed θp of the steel pipe to find the worked part peripheral speed Vp of the steel pipe and multiplies the speed θr of the working roll 6 with the working roll radius Rr to find the worked part peripheral speed Vr of the working roll 6. Further, the control apparatus 17 sends a control signal to the rotational motor 14 so that the difference Δ between the worked part peripheral speed Vr of the working roll and the worked part peripheral speed Vp of the steel pipe does not exceed the allowable range and continuously controls the speed θp of the steel pipe. In the present embodiment, the absolute value of the difference Δ between the worked part peripheral speed Vp and the worked part peripheral speed Vr does not exceed 4.5% of the worked part peripheral speed Vr. That is, $|\Delta| \leqq 0.045$ Vr is satisfied. If this range is exceeded, the twisting of the seam line becomes larger and defects occur more often. Note that while depending on the type, length, taper angle, etc. of the steel pipe, if $|\Delta| \leqq 0.02$ Vr, a higher quality tapered steel pipe can be produced.

Note that, the above embodiment is an example of attaching a speed detecting means 15 to only the working roll 6 and measuring the speed, but it is also possible to measure the speed of the receiving rollers 3*a*, 3*b*, and 3*c* (steel pipe support rolls) or the speed of the pullout side shaft 1*b* in real time, detect the twisting occurring at the different parts of the steel pipe P at a more advanced level, and minimize the overall twisting by control.

Figure 9:
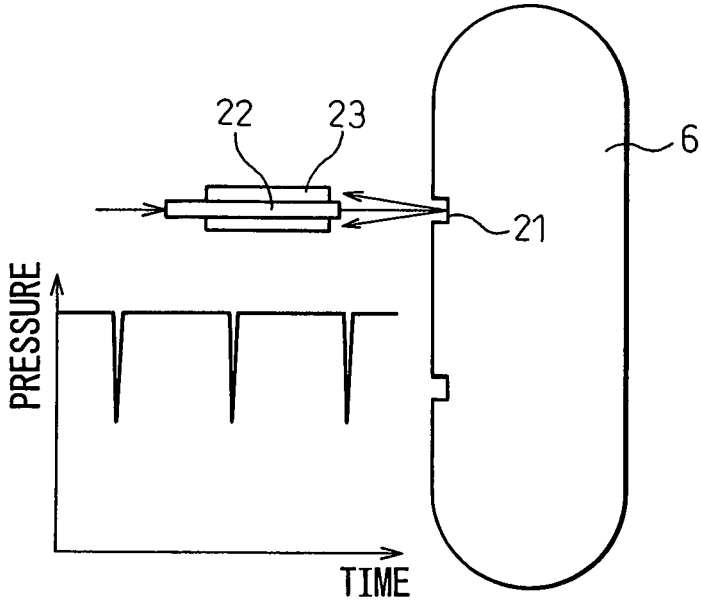
FIG. 9 is an explanatory view of an air pressure type speed detecting means.
Figure 10:
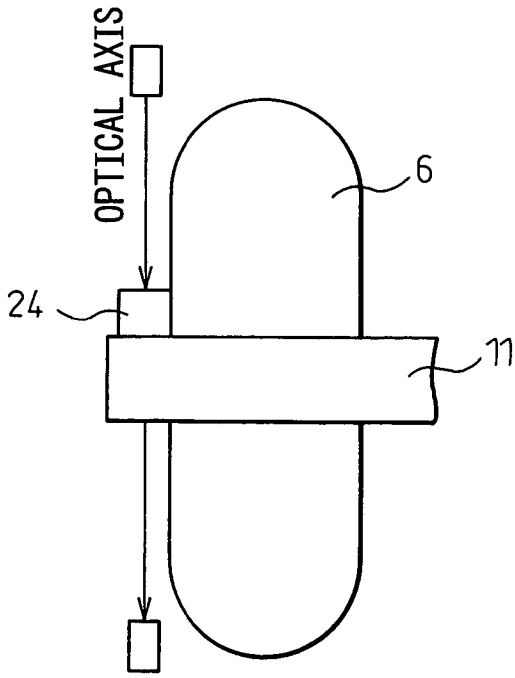
FIG. 10 is an explanatory view of an optical type speed detecting means.

Examples of embodiments of non-contact type sensors for measuring the speed θr of the working roll 6 are shown in FIG. 9 and FIG. 10. As shown in FIG. 9, the side surface of the working roll 6 is formed with a suitable number of recesses 21 at a certain radius. Air is ejected along the radius from nozzles 22 provided at somewhat separated positions. The states of reflection of the air flows differ at the parts with the recesses 21 and the smooth parts, so the pressure sensor 23 detects the waveform as shown in FIG. 9 in accordance with the rotation of the working roll 6. It is possible to find the speed θr of the working roll 6 from the waveform. The example shown in FIG. 10 is one where the shaft of the working roll 6 is provided with blades, slits, or other light changing means 24 and where the periodic change of light when the working roll 6 is rotating is utilized to optically find the speed θr of the working roll 6.

As explained above, according to the method of production of a tapered steel pipe of the present invention, the speed θr of the freely rotating working roll which was not measured in the past is preferably measured by a non-contact type sensor during the drawing operation to find the worked part peripheral speed Vr of the working roll. On the other hand, the worked part radius Rp of the steel pipe is found from the amount of pushing of the working roll in the direction of the center axis of the steel pipe and is multiplied with the speed θp of the steel pipe to find the worked part peripheral speed Vp of the steel pipe. Further, the speed θp of the steel pipe is continuously controlled so that the difference Δ between the worked part peripheral speed Vp of the steel pipe and the worked part peripheral speed Vr of the working roll does not exceed an allowable range. For this reason, even if raising the speed of production, the counterforce received by the steel pipe from the working roll can be reduced and tapered steel pipe with a length over 10 meters can be produced without twisting and with a good productivity.

Further, tapered steel pipe obtained by drawing a stock pipe with an outside diameter of 160 mm or less, tapered steel pipe with a maximum outside diameter of 150 mm or less, tapered steel pipe obtained by drawing a stock pipe with a thickness of less than 4.0 mm, and tapered steel pipe with a maximum thickness of less than 4.0 mm are weak in resistance to cross-sectional deformation of the steel pipe, while tapered steel pipe with a minimum outside diameter of 20% or less of the outside diameter of the stock pipe is high in taper rate, so the external force increases and the working instability itself increases. Conventionally, stable production was difficult, but the present invention enables stable production.

Figure 11:
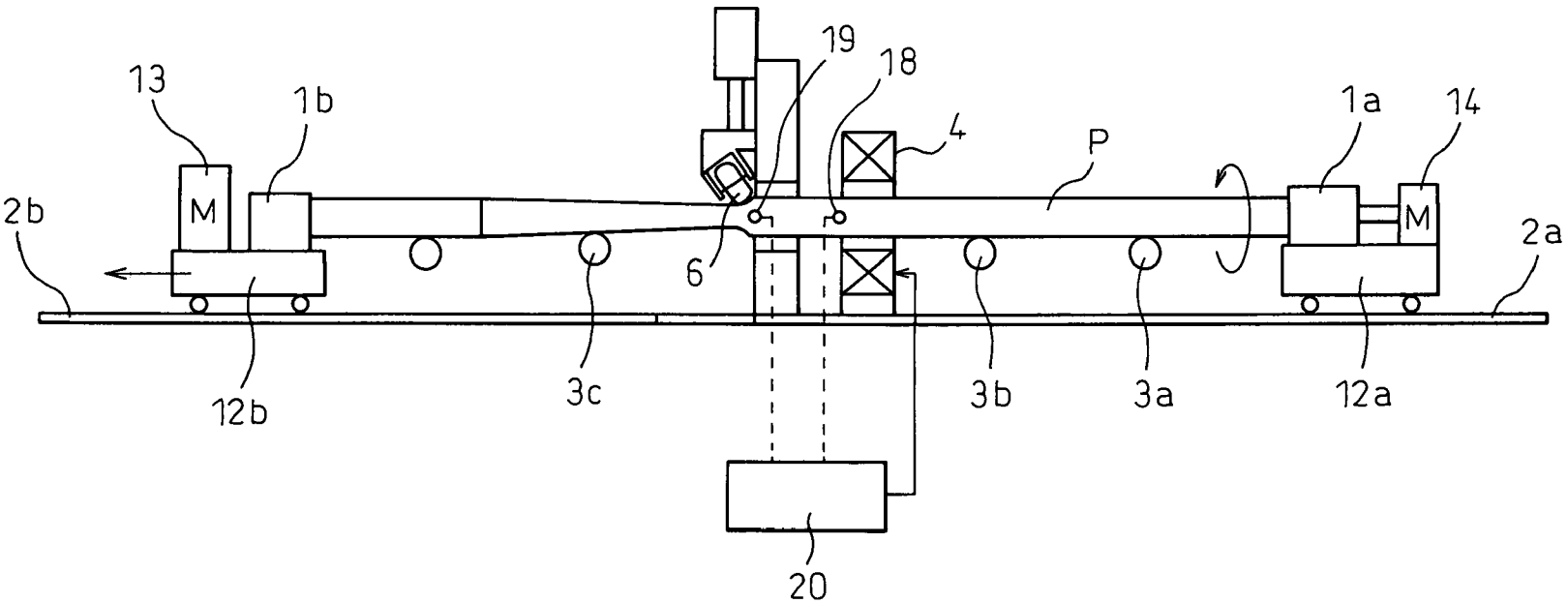
FIG. 11 is an overview of a tapered steel pipe production apparatus.

Next, the method of adjusting the output of the heating apparatus in accordance with the working conditions to enable optimum tapering so that the temperature of the heated part of the steel pipe reaching the working roll becomes the optimum working temperature (target temperature) will be explained. FIG. 11 is an overall view of an apparatus for producing a tapered steel pipe. The basic configuration is substantially the same as in the aspect shown in FIGS. 7 and 8. The heating apparatus 4 arranged at the entry side of the working roll 6 is an induction heating apparatus and heats the steel pipe P fed to the working rolls 6 to several hundred degrees centigrade. The method of control of the output of the heating apparatus 4 will be explained in detail below. Note that 3*a*, 3*b*, and 3*c* are receiving rollers for supporting the steel pipe P.

In the present embodiment, temperature detecting means 18 and 19 are provided at least right after the heating apparatus 4 and right before the working roll 6. The temperature detecting means 18 and 19 are preferably non-contact types, for example radiation thermometers, and detect the steel pipe temperatures at those positions. Further, the processing means 27 finds the difference of the temperatures detected by the temperature detecting means 18 and 19 and defines this as the amount of temperature drop of the steel pipe P from the heating apparatus 4 to the working position. Note that the temperature detecting means 18 is preferably arranged within 50 mm from the exit side of the heating apparatus 4, while the temperature detecting means 19 is preferably arranged so as to be able to measure the temperature within a range of 50 mm from the entry side of the working roll 6.

When the amount of drawing by the working roll 6 is constant (when the taper rate is zero and the speed is constant), the amount of temperature drop is constant and the steel pipe temperature at the exit side of the heating apparatus equals the optimum working temperature (target temperature) plus the amount of temperature drop. For this reason, the output of the heating apparatus 4 should be adjusted by instruction from the processing means 20 so that the actually measured temperature of the steel pipe P and the amount of temperature drop match their formulas. However, when tapering, when the amount of drawing continuously changes, the amount of temperature drop changes along with the worked position of the steel pipe P due to the change in speed of movement of the steel pipe in the axial direction at the entry side of the working roll along with the change in the amount of drawing, the change in the volume of the steel pipe cooled by the water-cooled working roll, etc.

Therefore, in the present invention, as a predicted value of the amount of temperature drop in the interval during which the steel pipe P moves from the heating apparatus 4 to the working roll 6, a suitable temperature drop constant is selected in accordance with the working conditions. The main condition among these working conditions is the amount of drawing. When making the working speed constant, the larger the amount of drawing, the lower the speed of movement of the steel pipe P in the axial direction at the entry side of the working roll, so the greater the temperature drop constant selected. For this reason, it is preferable to also continuously change the value of the temperature drop constant in accordance with the continuous change in the amount of drawing, but in practice it is sufficient to change the setting of the temperature drop constant in steps in the longitudinal direction of the steel pipe.

Figure 12:
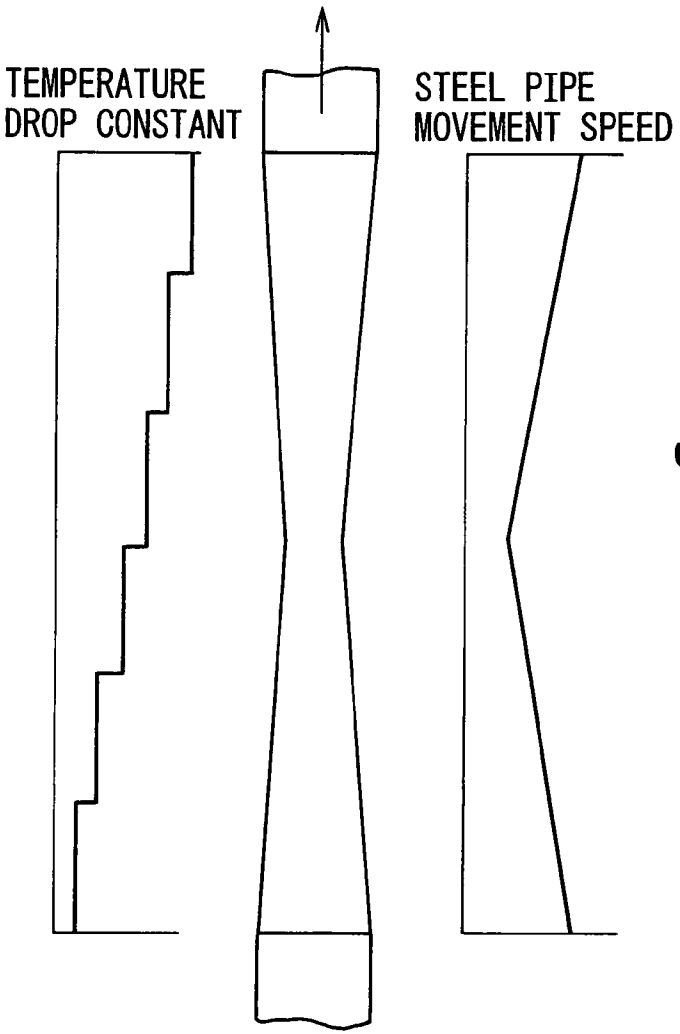
FIG. 12 is a view of the relationship between the speed of movement of steel pipe and a temperature drop constant in the case of extreme tapering.

For example, in the case of extreme tapering such as shown in FIG. 12, the speed of movement of the steel pipe in the axial direction at the entry side of the working roll falls along with the start of working of the taper and rises again after passing the center. In this case, in the first half of the tapering, the time required for the steel pipe P to move from the heating apparatus 4 to the working roll 6 becomes long and the amount of temperature drop due to air cooling becomes great. As opposed to this, if selecting a large temperature drop constant, the output of the heating apparatus 4 is increased so as to maintain the temperature of the steel pipe at the position drawn at the optimum working temperature (target temperature) even if the amount of temperature drop is large. Further, whether the measured amount of temperature drop and the set temperature drop constant match is detected. If there is a difference, during operation, the temperature drop constant is suitably corrected or the output of the heating apparatus 4 is suitably adjusted so that the measured value of the temperature of the steel pipe right before the working roll 6 becomes close to the target temperature and so that thereby the difference is made to approach zero.

On the other hand, in the latter half of the tapering, the time required for the steel pipe P to move from the heating apparatus 4 to the working position, that is, the working roll, becomes gradually shorter and the amount of temperature drop due to air cooling becomes smaller. Further, the steel pipe P is mostly already heated and has retained heat. For this reason, a smaller temperature drop constant is selected and the output of the heating apparatus 4 is reduced to control the temperature of the steel pipe at the position drawn so as not to exceed the optimum working temperature and to prevent overshoot. The temperature drop constant is preferably switched early in consideration of the time constant, but in practice it is sufficient to set the temperature drop constant at a pitch of several hundred mm in the longitudinal direction of the steel pipe.

Figure 13:
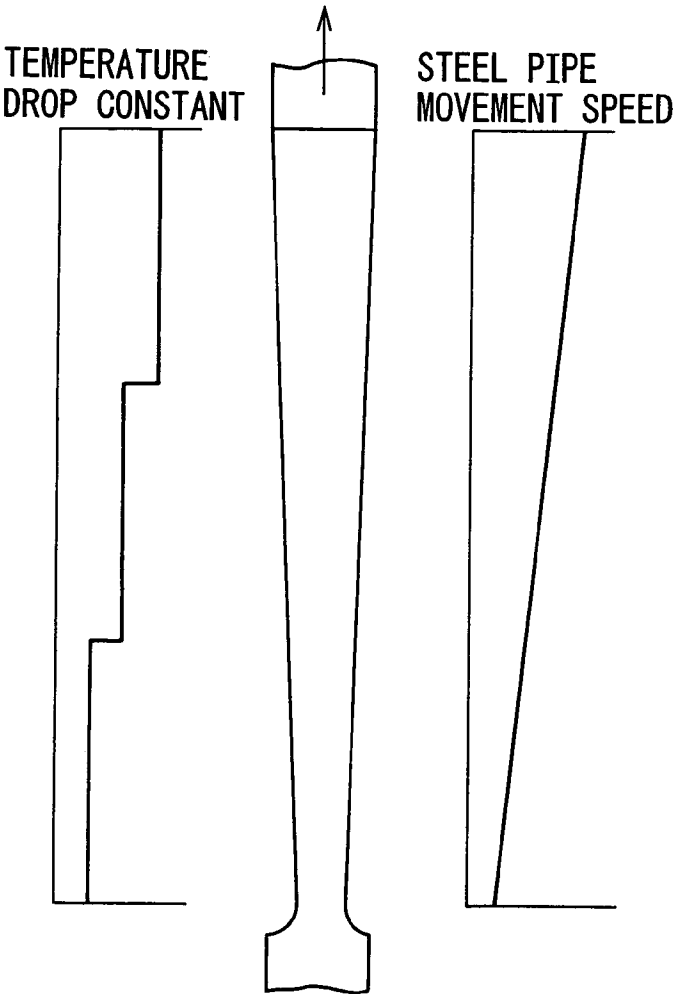
FIG. 13 is a view of the relationship between the speed of movement of steel pipe and a temperature drop constant in the case of ordinary tapering.
Figure 14:
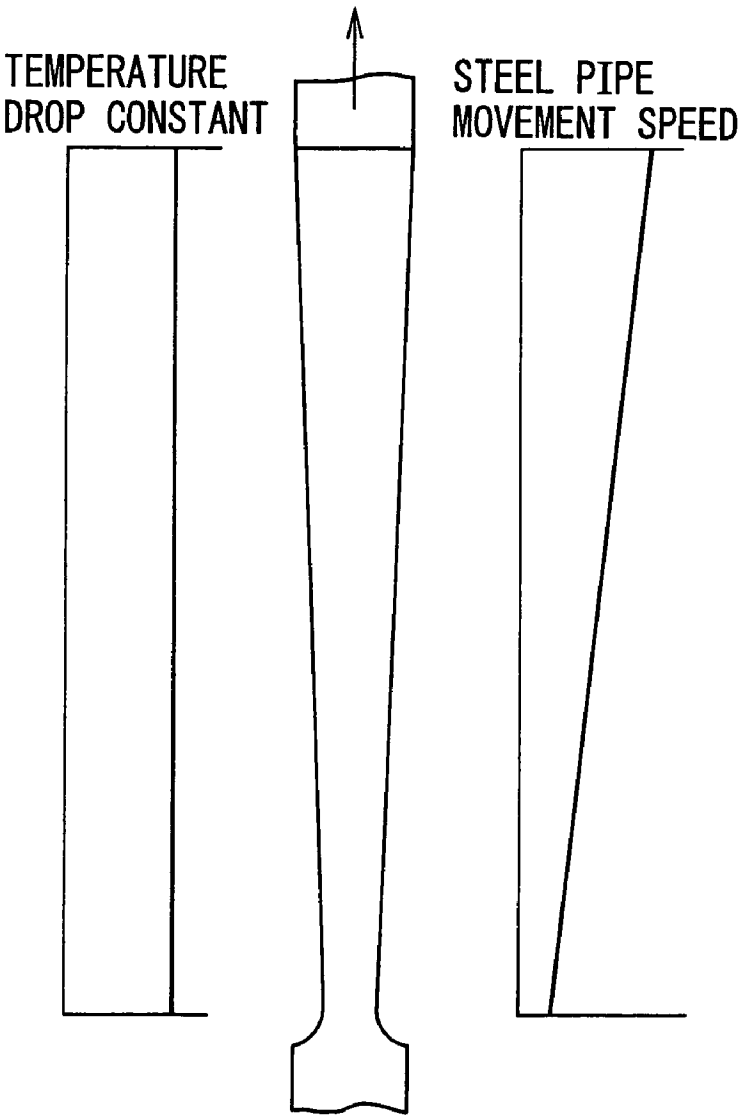
FIG. 14 is a view of a modification of FIG. 13.

Note that there are various methods of setting the suitable temperature drop constant in accordance with the tapering conditions. As shown in FIG. 13, sometimes it is preferable to set the temperature drop constant to become successively smaller in the longitudinal direction of the steel pipe along with the increase in the amount of drawing. Further, depending on the working conditions, as shown in FIG. 14, sometimes it is possible to set a constant temperature drop constant across the entire length of the steel pipe. In this way, a suitable value of the temperature drop constant should be selected in accordance with the working conditions at all times. It is preferable to convert the changes in the amount of temperature drop due to the working conditions to numerical values in advance as empirical values. That is, when the temperature drop constant set changed in the longitudinal direction of the steel pipe does not match with the actually measured value of the amount of temperature drop, the temperature drop constant is manually corrected to adjust the output of the heating apparatus and maintain the optimal working temperature. If this is possible, then it is possible to set the corrected temperature drop constant when drawing the pipe under the same conditions.

As explained above, in the present invention, the temperature drop constant is set in advance in accordance with the working conditions (amount of drawing and position of steel pipe) and the output of the heating apparatus 4 is adjusted in accordance with that to raise or lower the temperature at the exit side of the heating apparatus and thereby maintain the temperature of the steel pipe at the working position at the optimum working temperature (target temperature). Further, it is detected if the measured amount of temperature drop matches with the selected temperature drop constant and the output of the heating apparatus 4 is adjusted so that the difference approaches zero. Due to this, the optimum tapering becomes possible.

Further, in the present invention, since the temperature of the steel pipe at the exit side of the heating apparatus is constantly measured, it is possible to prevent the trouble of the steel pipe P being overheated at the heating apparatus 4. That is, it is also possible to realize the function of an interlock of the upper limit of heating by the heating apparatus 4.

Further, when the measured value of the initial temperature of the steel pipe P is a high temperature, it is possible to reduce the temperature drop constant, while when it is a low temperature, it is possible to increase the temperature drop constant so as to cope with fluctuations in the amount of temperature drop in air-cooling due to the season or time. In the summer and winter, it is not uncommon for the initial temperature of the steel pipe P to differ by 20° C. or more. In tapering with a slow temperature response, this temperature difference cannot be ignored. Therefore, stable tapering becomes possible regardless of the season according to the present invention.

EXAMPLE 1

The production apparatus shown in FIG. 7 was used to work electroresistance welded steel pipe with an outside diameter of 165.2 mm, a thickness of 4.5 mm, and a length of 9000 mm to a shape enabling two tapered steel pipes to be obtained as shown in FIG. 12. That is, two tapered steel pipes each with a taper length of 4500 mm, an outside diameter changing from 134.1 mm to 89.1 mm, and a thickness of 4.5 mm could be obtained. With the conventional method of not controlling the peripheral speed of the steel pipe and working roll, polygonal cross-sections or torsional deformation occurred with a high probability of a rate of occurrence of 50% or more. As opposed to this, by employing the method of production of the present invention of controlling the absolute value of the difference Δ between the worked part peripheral speed Vp of the steel pipe and the worked part peripheral speed Vr of the working roll, the defect rate was sharply reduced to 0.8% under conditions of $|\Delta|<0.045$ Vr and was completely suppressed under conditions of $|\Delta|<0.02$ Vr.

Further, by employing the method of the present invention controlling the absolute value of the difference Δ between the worked part peripheral speed Vp of the steel pipe and the worked part peripheral speed Vr of the working roll, the defect rate similarly was sharply reduced to 0.8% even for tapered steel pipe produced from stock pipe with an outside diameter of 160 mm or less produced with a defect rate of over 50% in the past, tapered steel pipe with a maximum outside diameter of 150 mm or less, tapered steel pipe produced from stock pipe with a thickness of less than 4.0 mm, a tapered steel pipe with a maximum thickness of less than 4.0 mm, and a tapered steel pipe with a minimum outside diameter of 20% or less than the outside diameter of the stock pipe.

Further, by employing this method of production, production of even tapered steel pipe produced from stock pipe with an outside diameter of 139.8 mm which in the past could only be produced with an extremely low efficiency due to the high defect rate and was therefore deemed substantially unproducible, tapered steel pipe with a maximum outside diameter of 114 mm, tapered steel pipe produced from stock pipe with a thickness of 3.5 mm, tapered steel pipe with a maximum thickness of 3.5 mm, and tapered steel pipe with a minimum outside diameter of 18% of the outside diameter of the stock pipe becomes possible. When these tapered steel pipes are vertical installed types, not only are they light in weight as a whole, but also they become lighter the higher up, so they are resistant to vibration and knock-down at the time of earthquakes and have small moment and are superior in fatigue strength, so the tapered steel pipes are extremely epochmaking in shape.

EXAMPLE 2

The apparatus shown in FIG. 11 was used to taper steel pipe with an outside diameter of 300 mm at a taper rate of 3/100 until 280 mm. It was learned that the optimum working temperature of the steel pipe was 700° C. As the initial value of the temperature drop constant during working (theoretical calculated value), 180° C. was selected. The output of the heating apparatus 4 was adjusted so that the steel pipe temperature of the exit side of the heating apparatus became 880° C. In the latter part of the working, the actually measured value of the amount of temperature drop became 190° C., so the temperature drop constant was made 190° C. and the temperature of the steel pipe at the exit side of the heating apparatus was raised to 890° C. As a result, it was possible to control the temperature of the steel pipe fed to the working roll to a range of 700° C.±20° C. and perform the tapering.

While the invention has been described with reference to specific embodiments chosen for purpose of illustration, it should be apparent that numerous modifications could be made thereto by those skilled in the art without departing from the basic concept and scope of the invention.

The invention claimed is:

1. A production apparatus for a tapered steel pipe which holds the two ends of the steel pipe by shafts on carriers and moves it in the axial direction while rotating it to draw it to a taper by an intermediate working roll, said production apparatus for a tapered steel pipe characterized in that the shaft of said working roll is inclined 20 to 40 degrees with respect to the axis of said steel pipe and wherein a contact surface of said working roll for rolling contact with the outer surface of said steel pipe has a steel pipe entry side and a steel pipe exit side and said contact surface of said working roll is provided by a projecting surface that results in little difference in peripheral speed of said contact surface along said contact surface between said entry side and said exit side of said contact surface.

2. A production apparatus for a tapered steel pipe as set forth in claim 1, wherein the a face plate for mounting the working roll is positioned and supported with respect to the body by a hinge mechanism and is fastened to the body by fastening members.

3. A production apparatus for a tapered steel pipe as set forth in claim 1, wherein a first bearing of the working roll at the side close to the steel pipe is made smaller than a second bearing at the side far from the steel pipe and the first and second hearings are connected by a tie-rod.

4. A production apparatus for a tapered steel pipe as set forth in claim 1, further provided with a steel pipe rotating means for rotating the shaft on at least one carrier among the shafts on the carriers holding the two ends of the steel pipe, a speed detecting means for measuring the speed θr of the working roll rotating due to contact with the steel pipe, and a control means for controlling the steel pipe rotating means based on the difference Δ between the worked part peripheral speed Vp of the steel pipe and the worked part peripheral speed Vr of the working roll.

5. A production apparatus for a tapered steel pipe as set forth in claim 4, wherein the speed detecting means of the working roll is a non-contact type sensor.

6. A method of production of a tapered steel pipe by a production apparatus for a tapered steel pipe as set forth in claim 4, further comprising measuring the speed θr of the working roll rotating due to contact with the steel pipe during drawing, finding the worked part peripheral speed Vr of the working roll from the speed θr, finding the worked part peripheral speed Vp of the steel pipe from the speed θp of the steel pipe, and controlling the speed θp of the steel pipe so that the absolute value of the difference Δ between the worked part peripheral speed Vp of the steel pipe and the worked part peripheral speed Vr of said working roll does not exceed an allowable range.

7. A method of production of a tapered steel pipe by a production apparatus for a tapered steel pipe as set forth in claim 6, wherein the absolute value of the difference Δ between the worked part peripheral speed Vp of the steel pipe and the worked part peripheral speed Vr of said working roll satisfies $|\Delta| \leqq 0.045$ Vr.

8. A production apparatus for a tapered steel pipe as set forth in claim 1, further having a heating apparatus at the entry side of the working roll, having temperature detecting means right after the heating apparatus and right before the working roll, and having a processing means for adjusting the output of the heating apparatus based on the temperature measured by the temperature detecting means and the temperature drop constant set in accordance with the working conditions.

9. A method of production of a tapered steel pipe by a production apparatus for a tapered steel pipe as set forth in claim 8, further comprising measuring the temperature of the steel pipe right after the heating apparatus and right before the working roll, adjusting the output of the heating apparatus so that the difference of the measurement value matches the amount of temperature drop calculated from the temperature drop constant set in accordance with the working conditions, and then drawing the pipe.

10. A method of production of a tapered steel pipe by a production apparatus for a tapered steel pipe as set forth in claim 9, further comprising changing the set value of the temperature drop constant in accordance with the amount of drawing.

11. A method of production of a tapered steel pipe by a production apparatus for a tapered steel pipe as set forth in claim 9, further comprising changing the set value of the temperature drop constant in steps in the longitudinal direction of the steel pipe.

* * * * *